US010651553B2

(12) United States Patent
Lee et al.

(10) Patent No.: US 10,651,553 B2
(45) Date of Patent: May 12, 2020

(54) ANTENNA STRUCTURE

(71) Applicant: WISTRON NEWEB CORPORATION, Hsinchu (TW)

(72) Inventors: Yun-Tsan Lee, Hsinchu (TW); Shih-Hsien Tseng, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 39 days.

(21) Appl. No.: 16/214,315

(22) Filed: Dec. 10, 2018

(65) Prior Publication Data

US 2019/0372215 A1 Dec. 5, 2019

(30) Foreign Application Priority Data

May 30, 2018 (TW) ..... 107118508 A

(51) Int. Cl.

| | |
|---|---|
| ***H01Q 1/24*** | (2006.01) |
| ***H01Q 1/38*** | (2006.01) |
| ***H01Q 1/52*** | (2006.01) |
| ***H01Q 5/35*** | (2015.01) |
| ***H01Q 1/48*** | (2006.01) |

(52) U.S. Cl.
CPC ..... *H01Q 1/523* (2013.01); *H01Q 1/48* (2013.01); *H01Q 5/35* (2015.01)

(58) Field of Classification Search
CPC .. H01Q 1/48; H01Q 1/38; H01Q 5/00; H01Q 1/52; H01Q 1/523; H01Q 5/35; H01Q 1/24; H01Q 1/243; H01Q 1/521; H01Q 5/37; H01Q 5/371; H01Q 5/378; H01Q 9/04; H01Q 9/42
See application file for complete search history.

(56) References Cited

U.S. PATENT DOCUMENTS 6,943,738 B1 * 9/2005 Mattsson ..... H01Q 1/243 343/700 MS
7,091,911 B2 * 8/2006 Qi ..... H01Q 1/243 343/702

(Continued)

FOREIGN PATENT DOCUMENTS

CN 205029016 U 2/2016
CN 205104610 U 3/2016

(Continued)

*Primary Examiner* — Tho G Phan
(74) *Attorney, Agent, or Firm* — McClure, Qualey & Rodack, LLP

(57) ABSTRACT

An antenna structure includes a substrate, a first antenna disposed on the substrate, a second antenna disposed on the substrate, a grounding member, a first feeding member and a second feeding member. The first antenna includes a first radiation portion, a second radiation portion, a first fed-in portion, and a first grounding portion spaced from the second radiation portion by a first gap. The second antenna includes a third radiation portion, a fourth radiation portion, a second fed-in portion and a second grounding portion spaced from the fourth radiation portion by a second gap. The first feeding member includes a first feed end coupled to the first fed-in portion and a first ground end coupled to the grounding member. The second feeding member includes a second feed end coupled to the second fed-in portion and a second ground end coupled to the grounding member.

17 Claims, 9 Drawing Sheets

(56) References Cited

U.S. PATENT DOCUMENTS

| | | | | |
|---|---|---|---|---|
| 7,501,991 | B2 * | 3/2009 | Yeap | H01Q 1/38 343/700 MS |
| 7,609,221 | B2 | 10/2009 | Chung et al. | |
| 8,373,604 | B2 * | 2/2013 | Wong | H01Q 1/243 343/702 |
| 8,552,914 | B2 * | 10/2013 | Xie | H01Q 9/0421 343/700 MS |
| 8,717,239 | B2 * | 5/2014 | Ko | H01Q 5/371 343/700 MS |
| 2002/0140612 | A1 | 10/2002 | Kadambi et al. | |
| 2003/0189522 | A1 * | 10/2003 | Zeilinger | H01Q 9/0421 343/702 |
| 2011/0084883 | A1 | 4/2011 | Wong et al. | |

FOREIGN PATENT DOCUMENTS

| | | | |
|---|---|---|---|
| TW | 200532987 | A | 10/2005 |
| TW | 200638605 | A | 11/2006 |
| TW | 201114101 | A | 4/2011 |
| TW | 201541708 | A | 11/2015 |

* cited by examiner

ANTENNA STRUCTURE

CROSS-REFERENCE TO RELATED PATENT APPLICATION

This application claims the benefit of priority to Taiwan Patent Application No. 107118508, filed on May 30, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the present disclosure described herein. All references cited and discussed in this specification are incorporated herein by reference in their entireties and to the same extent as if each reference was individually incorporated by reference.

FIELD OF THE DISCLOSURE

The present disclosure relates to an antenna structure, and more particularly to an antenna structure with increased isolation between two antennas.

BACKGROUND OF THE DISCLOSURE

With the increasing use of portable electronic devices (such as smart phones, tablets, and notebooks), wireless communication technologies for portable electronic devices have become more important in recent years. However, due to the emphasis on product miniaturization in recent years, the space in a notebook that had been able to accommodate two antennas has been greatly reduced. With a reduced installation space, when two antennas are disposed adjacent to each other, they will interfere with each other, and the features of the original antenna design will be compromised.

Therefore, it is important to design an antenna structure which improves the isolation between two antennas and reduces the mutual interference therebetween while retaining their original characteristics so as to overcome the above difficulties.

SUMMARY OF THE DISCLOSURE

In response to the above-referenced technical issues, the present disclosure provides an antenna structure with increased isolation between two antennas.

One aspect of the present disclosure directs to an antenna structure. The antenna structure includes a substrate, a first antenna disposed on the substrate, a second antenna disposed on the substrate, a grounding member, a first feeding member and a second feeding member. The first antenna includes a first radiation portion, a second radiation portion, a first fed-in portion and a first grounding portion. The first fed-in portion is coupled between the first radiation portion and the second radiation portion. The first grounding portion is coupled to the first fed-in portion. The second antenna includes a third radiation portion, a fourth radiation portion, a second fed-in portion and a second grounding portion. The second fed-in portion is coupled between the third radiation portion and the fourth radiation portion. The second grounding portion is coupled to the second fed-in portion. The grounding member is coupled to the first grounding portion and the second grounding portion. The first feeding member is for feeding in a first signal. The first feeding member includes a first feed end coupled to the first fed-in portion, and a first ground end coupled to the grounding member. The second feeding member is for feeding in a second signal. The second feeding member includes a second feed end coupled to the second fed-in portion, and a second ground end coupled to the grounding member. The first feed end and the first radiation portion forms a first current path, the first feed end and the second radiation portion forms a second current path, the first feed end and the first grounding portion forms a first ground current path, and the first current path, the second current path and the first ground current path do not overlap with each other. The second feed end and the third radiation portion forms a third current path, the second feed end and the fourth radiation portion forms a fourth current path, the second feed end and the second grounding portion forms a second ground current path, and the third current path, the fourth current path and the second ground current path do not overlap with each other.

One aspect of the present disclosure directs to an antenna structure. The antenna structure includes a substrate, a first antenna disposed on the substrate, a second antenna disposed on the substrate, a grounding member, a first feeding member and a second feeding member. The first antenna includes a first radiation portion, a second radiation portion, a first fed-in portion and a first grounding portion. The first fed-in portion is coupled between the first radiation portion and the second radiation portion. The first grounding portion is coupled to the first fed-in portion. The second antenna includes a third radiation portion, a fourth radiation portion, a second fed-in portion and a second grounding portion. The second fed-in portion is coupled between the third radiation portion and the fourth radiation portion. The second grounding portion is coupled to the second fed-in portion. The grounding member is coupled to the first grounding portion and the second grounding portion. The first feeding member is for feeding in a first signal. The first feeding member includes a first feed end coupled to the first fed-in portion, and a first ground end coupled to the grounding member. The second feeding member is for feeding in a second signal. The second feeding member includes a second feed end coupled to the second fed-in portion, and a second ground end coupled to the grounding member. A first gap is provided between the second radiation portion and the first grounding portion, and a second gap is provided between the fourth radiation portion and the second grounding portion.

Therefore, through the technical features of "the grounding member is coupled to the first grounding portion of the first antenna and the second grounding portion of the second antenna," the antenna structure of the present disclosure has reduced mutual current interference between the first antenna and the second antenna, and therefore improved isolation between the first antenna and the second antenna.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
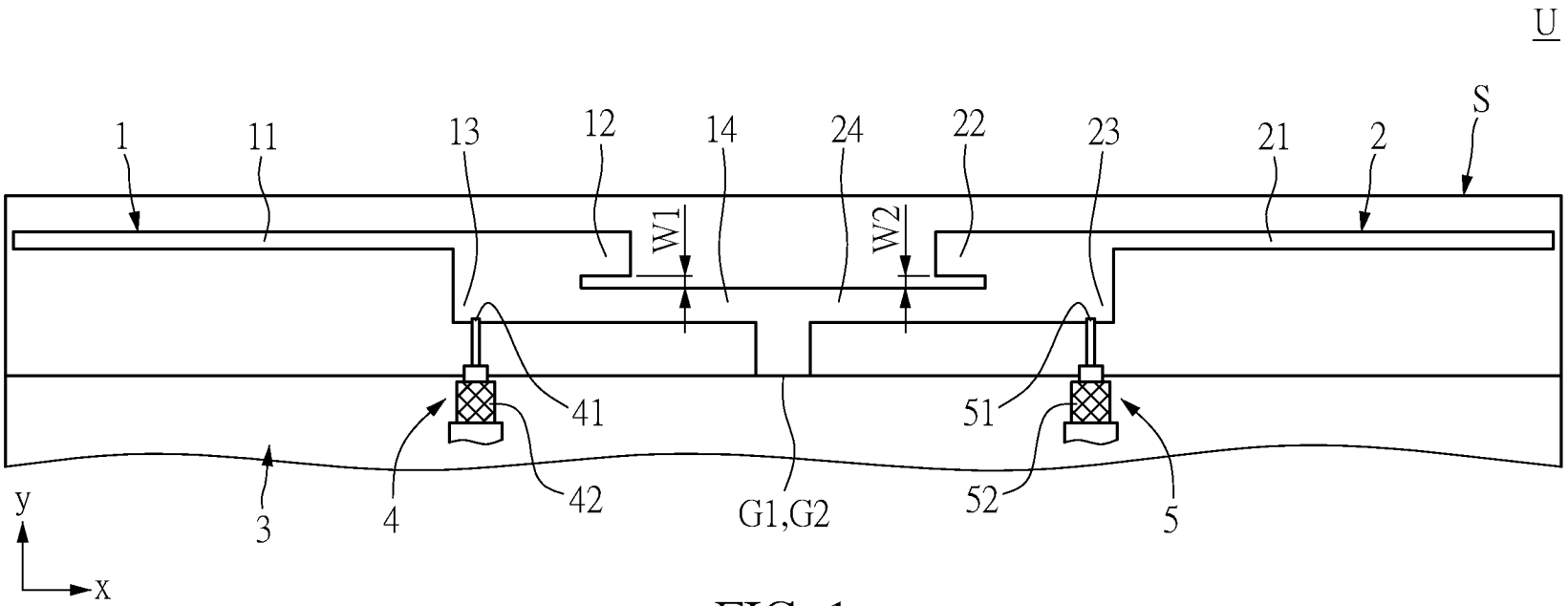
FIG. 1 is a top view of a configuration of an antenna structure according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Reference is made to FIG. 1, which is a top view of a configuration of an antenna structure U according to a first embodiment of the present disclosure. The present disclosure provides the antenna structure U including a substrate S, a first antenna 1, a second antenna 2, a grounding member 3, a first feeding member 4, and a second feeding member 5. For example, the first antenna 1 and the second antenna 2 can be disposed on the substrate S. In addition, for example, the first antenna 1 and the second antenna 2 can be a metal piece, a metal wire or a conductive body. The substrate S can be a printed circuit board (PCB). However, the present disclosure is not limited to the above examples. In addition, for example, the antenna structure U can be of a multi-input multi-output (MIMO) antenna architecture. However the present disclosure is not limited thereto.

Further, referring again to FIG. 1, the first antenna 1 includes a first radiation portion 11, a second radiation portion 12, a first fed-in portion 13 coupled between the first radiation portion 11 and the second radiation portion 12, and a first grounding portion 14 coupled to the first fed-in portion 13. The second antenna 2 is adjacent to the first antenna 1. The second antenna 2 includes a third radiation portion 21, a fourth radiation portion 22, a second fed-in portion 23 coupled between the third radiation portion 21 and the fourth radiation portion 22, and a second grounding portion 24 coupled to the second fed-in portion 23. Further, the grounding member 3 can be coupled to the first grounding portion 14 and the second grounding portion 24. Further, it should be noted that the first radiation portion 11, the second radiation portion 12, the first fed-in portion 13, and the first grounding portion 14 can be an integrally formed metal piece. In addition, the third radiation portion 21, the fourth radiation portion 22, the second fed-in portion 23, and the second grounding portion 24 can be an integrally formed metal piece. In addition, the first grounding portion 14 and the second grounding portion 24 can be located between the first fed-in portion 13 and the second fed-in portion 23, such that the first grounding portion 14 and the second grounding portion 24 are adjacent to each other.

Further, referring again to FIG. 1, in the first embodiment, the first grounding portion 14 of the first antenna 1 can be directly connected with the second grounding portion 24 of the second antenna 2 to form a common grounding portion (not labeled in the figure; formed by the first grounding portion 14 and the second grounding portion 24), so that the first antenna 1 and the second antenna 2 are integrally formed as a metal piece. However, the present disclosure is not limited thereto. In other words, in the first embodiment, the first antenna 1 and the second antenna 2 have a common grounding structure. In addition, in the second embodiment of the present disclosure, the first grounding portion 14 of the first antenna 1 can be adjacent to and separated from the second grounding portion 24.

Further, referring again to FIG. 1, the first feeding member 4 includes a first feed end 41 and a first ground end 42. The first feed end 41 is coupled to the first fed-in portion 13, and the first ground end 42 is coupled to the grounding member 3. The first feeding member 4 is used to feed in a first signal. The second feeding member 5 includes a second feed end 51 and a second ground end 52. The second feed end 51 is coupled to the second fed-in portion 23, and the second ground end 52 is coupled to the grounding member 3. The second feed end 51 is used to feed in a second signal. For example, each of the first feed member 4 and the second feed member 5 can be a coaxial cable. However, the present disclosure is not limited thereto. In addition, it should be particularly noted that the term "coupling" referred to throughout the present disclosure can be a direct connection, an indirect connection, a direct electrical connection or an indirect electrical connection, and the present disclosure is not limited thereto.

Next, referring again to FIG. 1, the shape and the characteristics of the first antenna 1 can be similar to that of the second antenna 2. Therefore, the first antenna 1 and the second antenna 2 can be symmetrically arranged as shown in FIG. 1. However, the present disclosure is not limited thereto, that is, in other embodiments, the characteristics of the first antenna 1 can be different from that of the second antenna 2. Further, the first radiation portion 11 and the fourth radiation portion 22 can both extend toward a first direction (for example, the negative x direction), and the second radiation portion 12 and the third radiation portion 21 can both extend toward a second direction (for example, the positive x direction). The first direction and the second direction are different from each other. For example, in the embodiment shown in FIG. 1, the first direction and the second direction are opposite to each other.

Further, referring again to FIG. 1, the first radiation portion 11 can generate a first operating frequency band, the second radiation portion 12 can generate a second operating frequency band, the third radiation portion 21 can generate a third operating frequency band, and the fourth radiation portion 22 can generate a fourth operating frequency band. Further, the frequency of the first operating frequency band and the third operating frequency band can range from 2400 MHz to 2500 MHz, and the frequency of the second operating frequency band and the fourth operating frequency band can range between 5000 MHz and 6000 MHz. However, the present disclosure is not limited thereto.

Further, referring again to FIG. 1, a first interval W1 can be provided between the second radiation portion 12 and the first grounding portion 14, and a second interval W2 can be provided between the fourth radiation portion 22 and the second grounding portion 24. Thereby, through the arrangement of the first interval W1, the first radiation portion 11, the second radiation portion 12 and the first fed-in portion 13 can collectively form a T-like shape. Further, through the arrangement of the second interval W2, the third radiation portion 21, the fourth radiation portion 22 and the second fed-in portion 23 can collectively form a T-like shape.

Further, referring again to FIG. 1, the first grounding portion 14 is coupled to the grounding member 3 at a first grounding site G1. A length between the first feed end 41 and the first grounding site G1 is defined as a first electrical length. The first electrical length is substantially one-fourth (¼) of the wavelength of a center frequency in a lowest operating frequency band of the first antenna 1. In other words, in the embodiment shown in FIG. 1, the lowest operating frequency band of the first antenna 1 can be between 2400 MHz and 2500 MHz. In addition, the second grounding portion 24 can be coupled to the grounding member 3 at a second grounding site G2, and a length between the second feed end 51 and the second grounding site G2 is defined as a second electrical length. The second electrical length is substantially one-fourth (¼) of the wavelength of the wavelength of a center frequency in a lowest operating frequency band of the second antenna 2. In other words, in the embodiment shown in FIG. 1, the lowest operating frequency band of the second antenna 2 can be between 2400 MHz and 2500 MHz.

Figure 2:
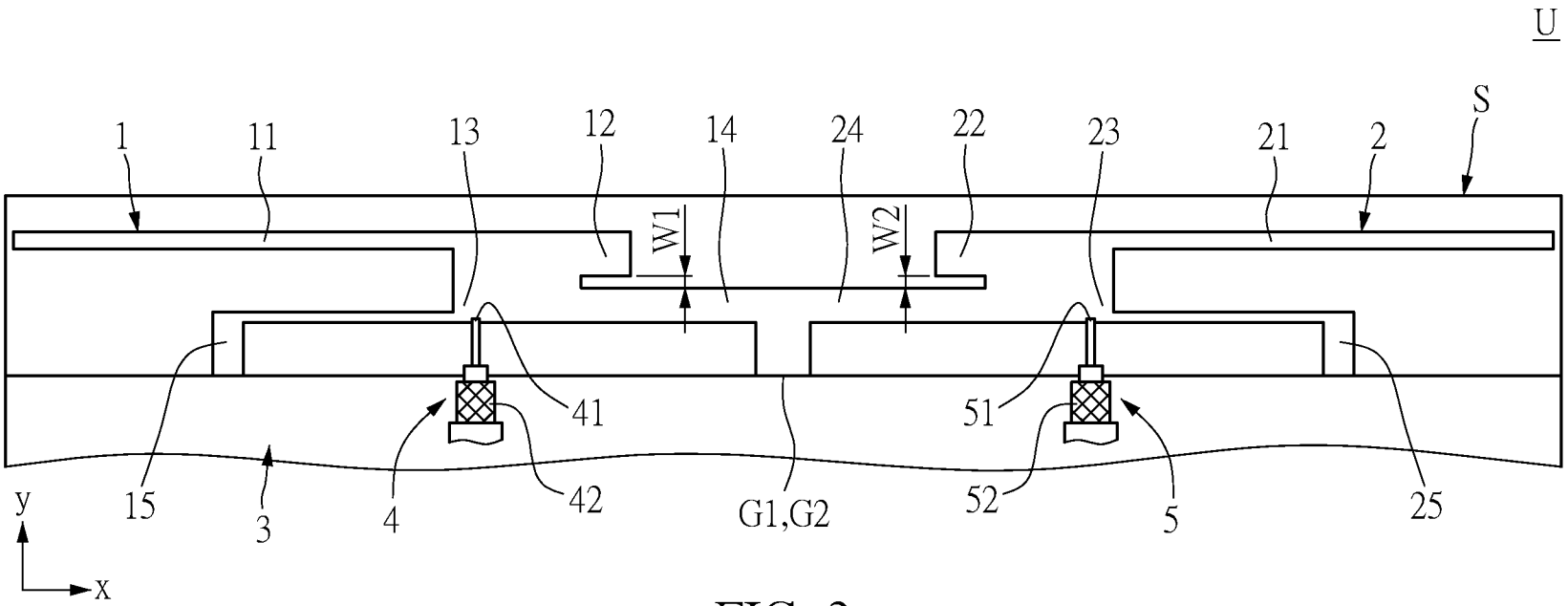
FIG. 2 is a top view of another configuration of the antenna structure according to the first embodiment of the present disclosure.

Further, reference is made both to FIG. 1 and FIG. 2. FIG. 2 is a top view of another configuration of the antenna structure U according to the first embodiment of the present disclosure. Through the comparison between FIG. 2 and FIG. 1, it can be seen that one of their differences is that, in the configuration shown in FIG. 2, the first antenna 1 further includes a third grounding portion 15 coupled to the first fed-in portion 13, the second antenna 2 further includes a fourth grounding portion 25 coupled to the second fed-in portion 23, and the first grounding portion 14 and the second grounding portion 24 are located between the third grounding portion 15 and the fourth grounding portion 25. That is to say, through the adoption of the third grounding portion 15 and the fourth grounding portion 25, the first antenna 1 and the second antenna 2 can be formed into a planar inverted-F antenna (PIFA). Further, the impedance matching and the bandwidth of the first antenna 1 can be adjusted by the third grounding portion 15, and the impedance matching and the bandwidth of the second antenna 2 can be adjusted by the fourth grounding portion 25.

Figure 3:
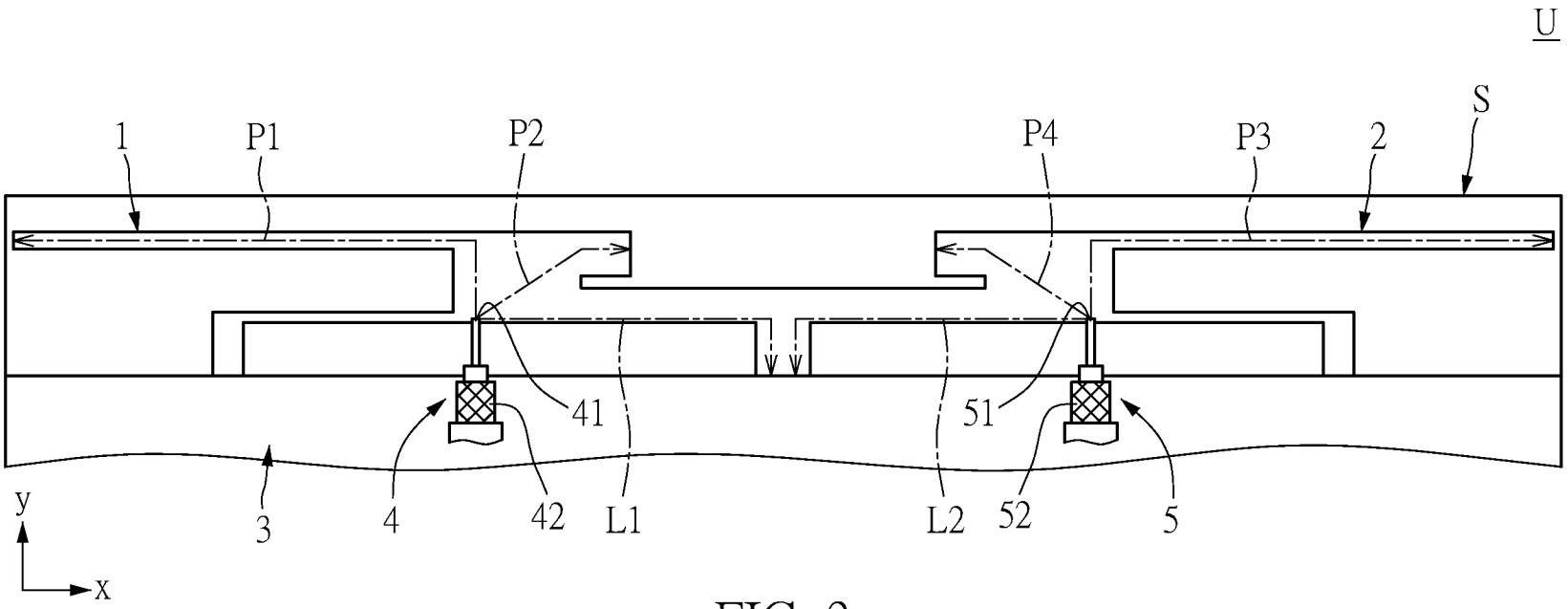
FIG. 3 is a schematic diagram showing the current paths of the antenna structure shown in FIG. 2.

Further, reference is made both to FIG. 1 and FIG. 3. FIG. 3 is a schematic diagram showing the current paths of the antenna structure U shown in FIG. 2. Specifically, the first feeding member 4 is configured to feed in a first signal, so that the first feed end 41 and the first radiation portion 11 form a first current path P1, the first feed end 41 and the second radiation portion 12 form a second current path P2, and the first feed end 41 and the first grounding portion 14 form a first ground current path L1. Since it is characteristic of a current to travel the shortest path, the first current path P1, the second current path P2 and the first ground current path L1 do not overlap with each other. In addition, the second feeding member 5 is configured to feed in a second signal. Therefore, the second feed end 51 and the third radiation portion 21 form a third current path P3, the second feed end 51 and the fourth radiation portion 22 form a fourth current path P4, and the second feed end 51 and the second grounding portion 24 form a second ground current path L2. Since it is characteristic of a current to travel the shortest path, the third current path P3, the four current path P4 and the second ground current path L2 do not overlap with each other. In other words, in order to achieve the effect that the first current path P1, the second current path P2 and the first ground current path L1 do not overlap with each other, the first interval W1 can be provided between the second radiation portion 12 and the first grounding portion 14. In order to achieve the effect that the third current path P3, the fourth current path P4 and the second ground current path L2 do not overlap with each other, the second interval W2 can be provided between the fourth radiation portion 22 and the second grounding portion 24.

Figure 4:
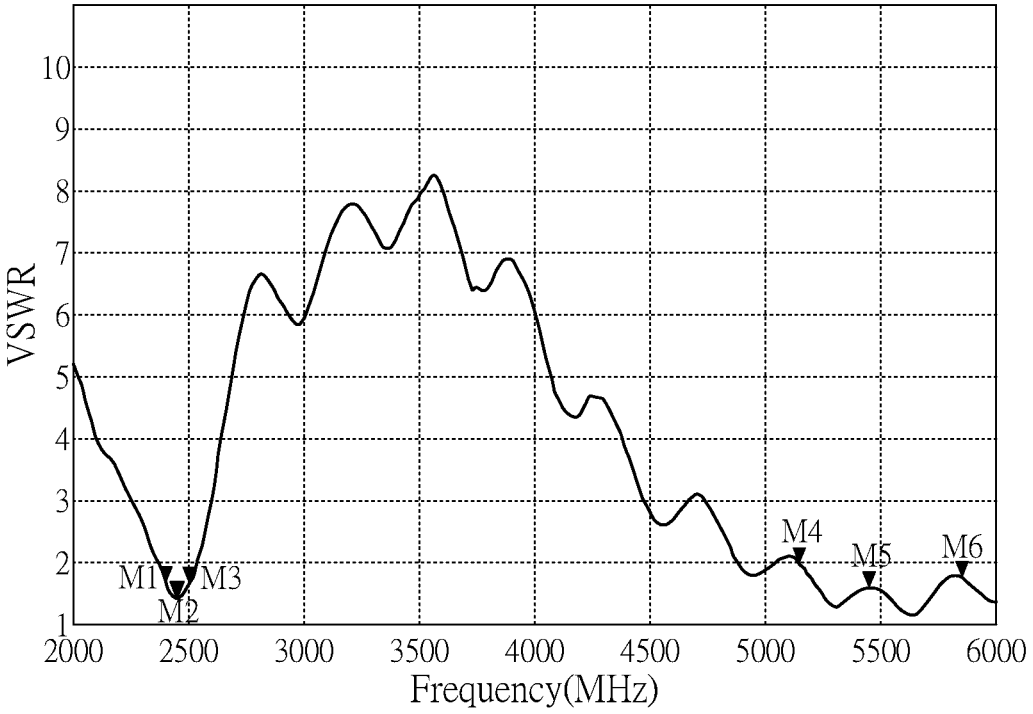
FIG. 4 is a curve graph of the voltage standing wave ratio (VSWR) values of the antenna structure shown in FIG. 2 at different frequencies.

Next, reference is made to FIG. 4 and the following Table 1. FIG. 4 is a curve graph of the VSWR values of the antenna structure U shown in FIG. 2 at different frequencies.

TABLE 1

| Node | Frequency (MHz) | VSWR |
|---|---|---|
| M1 | 2400 | 1.68 |
| M2 | 2450 | 1.43 |
| M3 | 2500 | 1.66 |
| M4 | 5150 | 1.98 |
| M5 | 5450 | 1.60 |
| M6 | 5850 | 1.76 |

Figure 5:
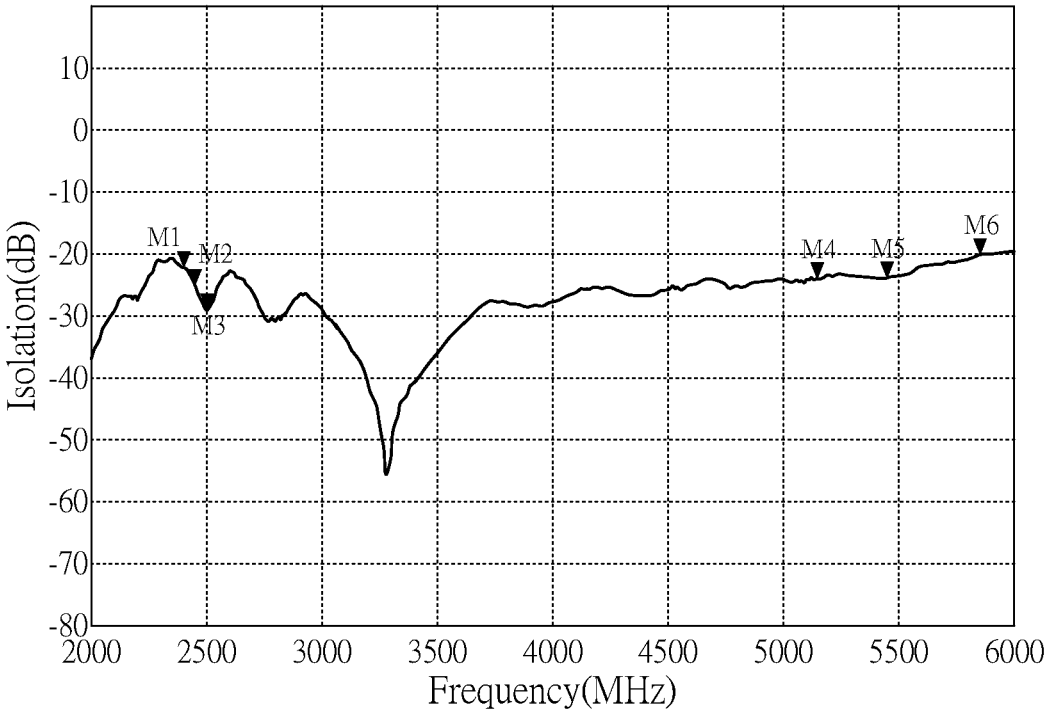
FIG. 5 is a curve graph of the isolation values of the antenna structure shown in FIG. 2 at different frequencies.

Next, reference is made to FIG. 5 and the following Table 2. FIG. 5 is a curve graph of the isolation values of the antenna structure U shown in FIG. 2 at different frequencies.

TABLE 2

| Node | Frequency (MHz) | Isolation(dB) |
|---|---|---|
| M1 | 2400 | −21.98 |
| M2 | 2450 | −24.94 |

TABLE 2-continued

| Node | Frequency (MHz) | Isolation(dB) |
|---|---|---|
| M3 | 2500 | −29.11 |
| M4 | 5150 | −24.33 |
| M5 | 5450 | −23.71 |
| M6 | 5850 | −20.33 |

Figure 6:
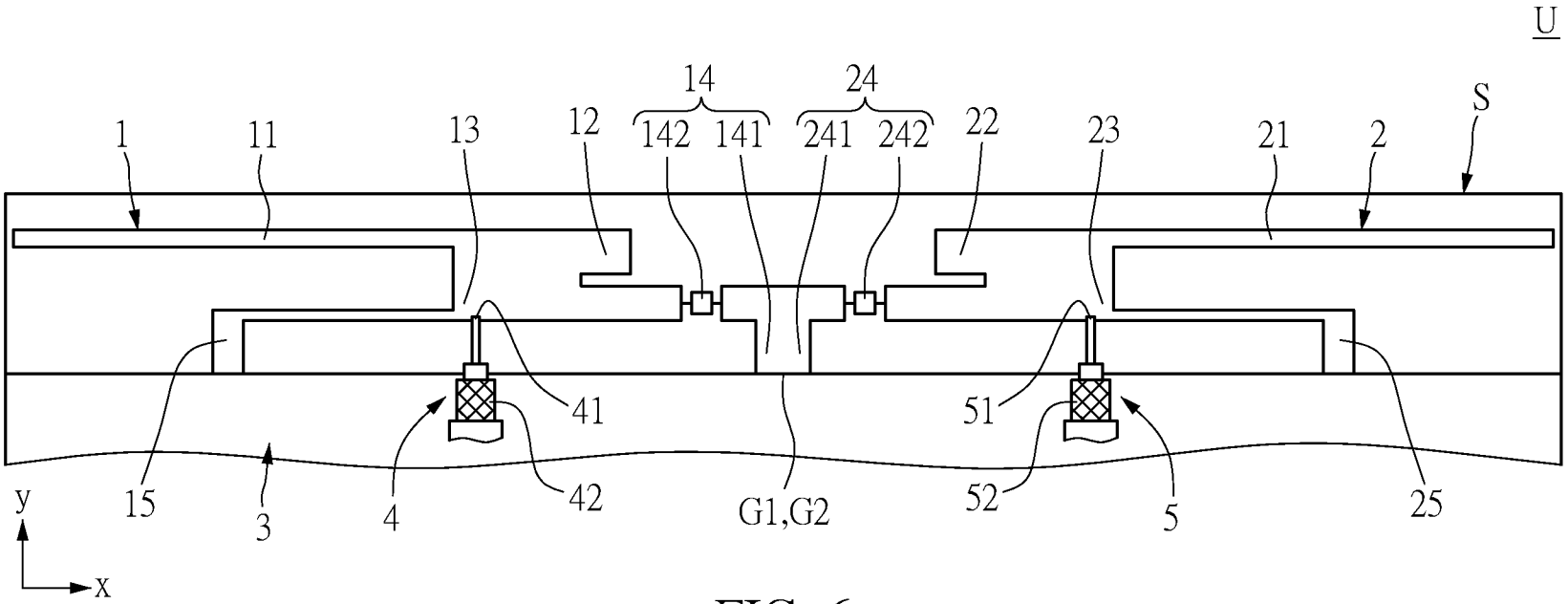
FIG. 6 is a top view of still another configuration of the antenna structure according to the first embodiment of the present disclosure.

Next, reference is made both to FIG. 2 and FIG. 6. FIG. 6 is a top view of still another configuration of the antenna structure U according to the first embodiment of the present disclosure. Through the comparison between FIG. 6 and FIG. 2, it can be seen that in the configuration shown in FIG. 6, the first grounding portion 14 includes a first grounding structure 141 and a first impedance element 142 coupled to the first grounding structure 141. For example, the first impedance element 142 can include a resistor, an inductor or a capacitor. In addition, the second grounding portion 24 includes a second grounding structure 241 and a second impedance element 242 coupled to the second grounding structure 241. For example, the second impedance element 242 can include a resistor, an inductor or a capacitor. In other words, the first grounding portion 14 can have a first impedance element 142 connected in series on the first ground current path L1, and the second grounding portion 24 can have a second impedance element 242 connected in series on the second ground current path L2. In certain configurations, since a resistor may affect gains, each of the first impedance element 142 and the second impedance element 242 can be an inductor or a capacitor. However, the present disclosure is not limited thereto. It should be noted that the first electrical length of the first grounding portion 14 provided with the first impedance element 142 is still substantially equivalent to one-fourth (¼) of the wavelength of a center frequency of one lowest operating frequency band of the first antenna 1. In addition, the second electrical length of the second grounding portion 24 provided with the second impedance element 242 is still substantially equivalent to one-fourth (¼) of the wavelength of a center frequency of one lowest operating frequency band of the second antenna 2.

Figure 7:
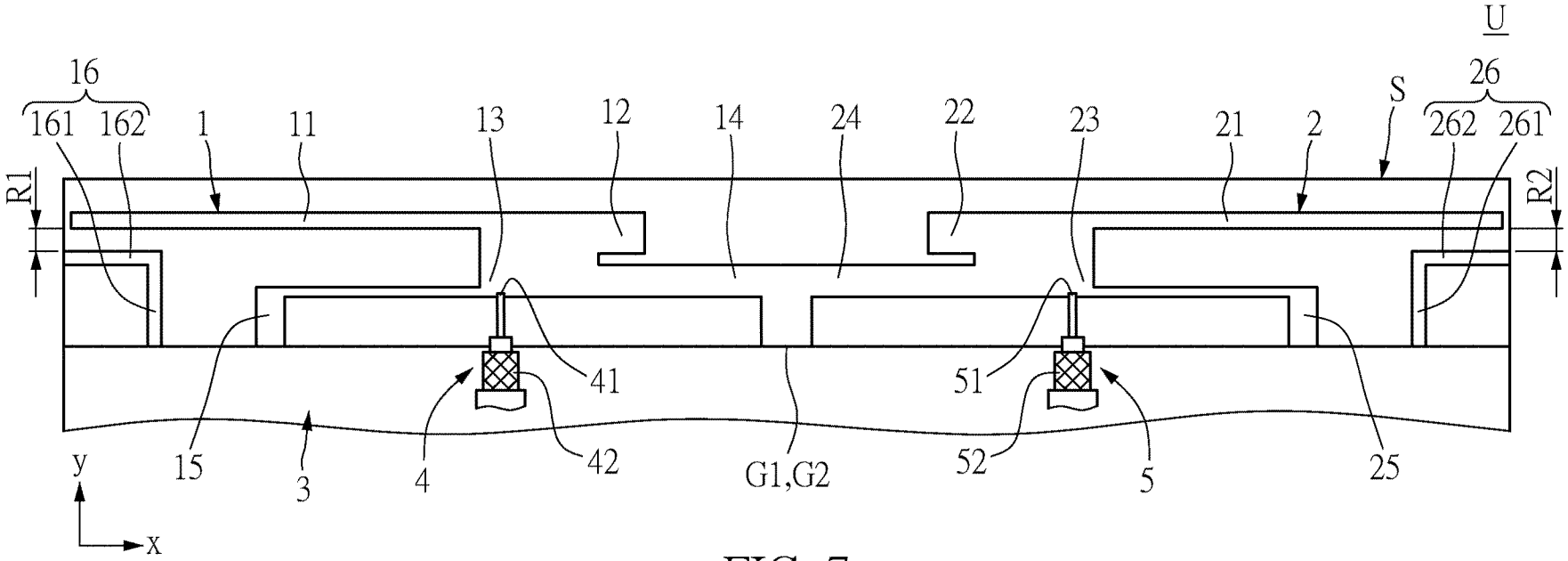
FIG. 7 is a top view of still another configuration of the antenna structure according to the first embodiment of the present disclosure.

Next, reference is made both to FIG. 2 and FIG. 7. FIG. 7 is a top view of still another configuration of the antenna structure U according to the first embodiment of the present disclosure. From the comparison between FIG. 7 and FIG. 2, it can be seen that in the configuration shown in FIG. 7, the first antenna 1 further includes a first parasitic member 16. The first parasitic member 16 is disposed on the substrate S, and has a first parasitic portion 161 coupled to the grounding member 3 and a second parasitic portion 162 bent from the first parasitic portion 161 and extending along a direction away from the first fed-in portion 13. The second parasitic portion 162 is adjacent to the first radiation portion 11. In addition, the second antenna 2 further includes a second parasitic member 26. The second parasitic member 26 is disposed on the substrate S and coupled to the grounding member 3. The second parasitic member 26 has a third parasitic portion 261 coupled to the grounding member 3 and a fourth parasitic portion 262 bent from the third parasitic portion 261 and extending along a direction away from the second fed-in portion 23. The fourth parasitic portion 262 is adjacent to the third radiation portion 21.

Further, referring again to FIG. 7, through the adoption of the first parasitic member 16, the gain of the first operating frequency band of the first antenna 1 can be increased, and through the adoption of the second parasitic member 26, the gain of the third operating frequency band of the second antenna 2 can be increased. It is worth noting that either one or two of the first parasitic member 16 and the second parasitic member 26 can be adopted in the present disclosure to adjust the gain of at least one of the first antenna 1 and the second antenna 2. However, the present disclosure is not limited thereto.

Further, referring again to FIG. 7, a first predetermined slit R1 is provided between the second parasitic portion 162 of the first parasitic member 16 and the first radiation portion 11 (the distance between the second parasitic portion 162 of the first parasitic member 16 and the first radiation portion 11). Further, by adjusting the width of the first predetermined slit R1 between the second parasitic portion 162 and the first radiation portion 11, the impedance value corresponding to the center frequency of the first operating frequency band of the first antenna 1 can be adjusted, and therefore the VSWR value corresponding to the center frequency of at least one operating frequency band can be adjusted. In addition, a second predetermined slit R2 can be provided between the fourth parasitic portion 262 of the second parasitic member 26 and the third radiation portion 21 (the distance between the fourth parasitic portion 262 of the second parasitic member 26 and the third portion 21). By adjusting the width of the second predetermined slit R2 between the fourth parasitic portion 262 and the third radiation portion 21, the impedance value corresponding to the center frequency of the third operating frequency band of the second antenna 2 can be adjusted, and therefore the VSWR value corresponding to the center frequency of at least one operating frequency band can be adjusted. In addition, it should be noted that, in other embodiments, the antenna structure U having the first parasitic member 16 and the second parasitic member 26 can further be provided with at least one of the first impedance element 142 and the second impedance element 242 shown in FIG. 6 (the first impedance element 142 and the second impedance element 242 are not shown in the FIG. 7). However, the present disclosure is not limited thereto.

Second Embodiment

Figure 8:
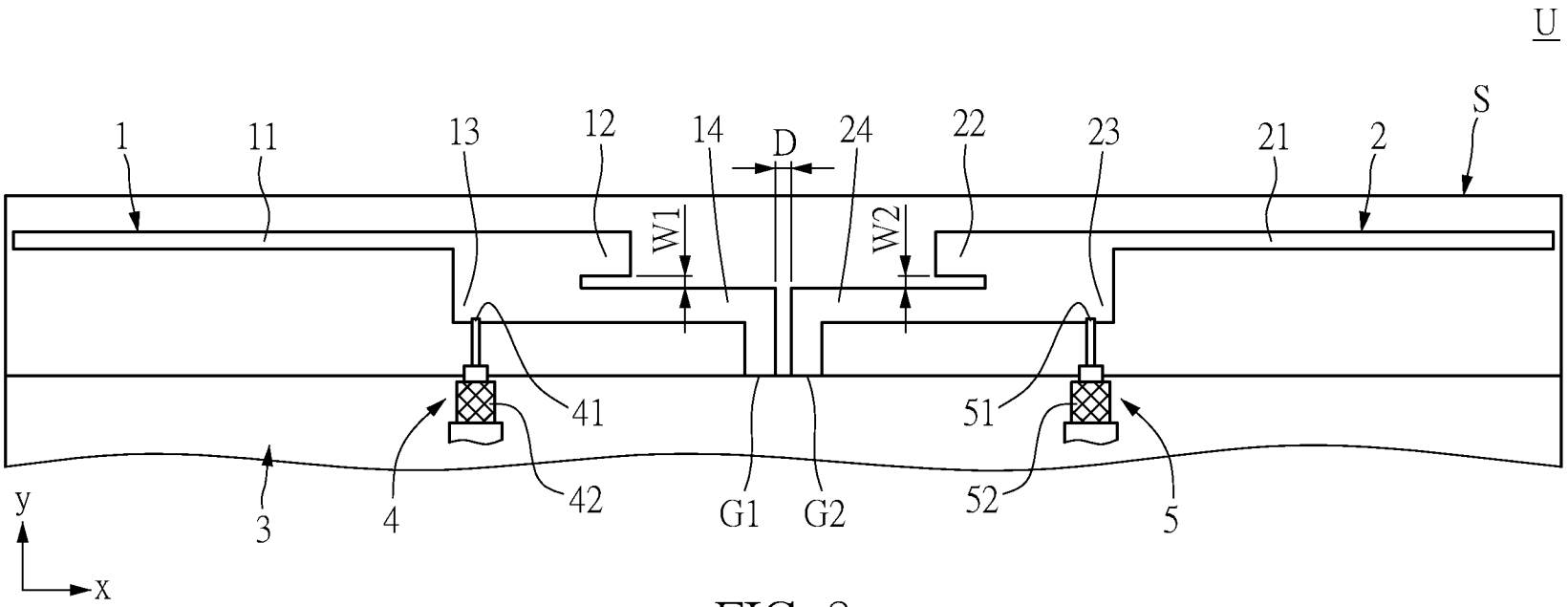
FIG. 8 is a top view of a configuration of the antenna structure according to a second embodiment of the present disclosure.

First, reference is made to FIG. 8, which is a top view of a configuration of an antenna structure U according to a second embodiment of the present disclosure. As can be seen from the comparison between FIG. 8 and FIG. 1, one of the differences between the second embodiment and the first embodiment is that in the second embodiment, the first grounding portion 14 and the second grounding portion 24 are separated from each other. Further, a predetermined distance D is provided between the first grounding portion 14 and the second grounding portion 24. In addition, description for certain structural features shown in the second embodiment similar to those in the foregoing embodiment is omitted herein for brevity.

Figure 9:
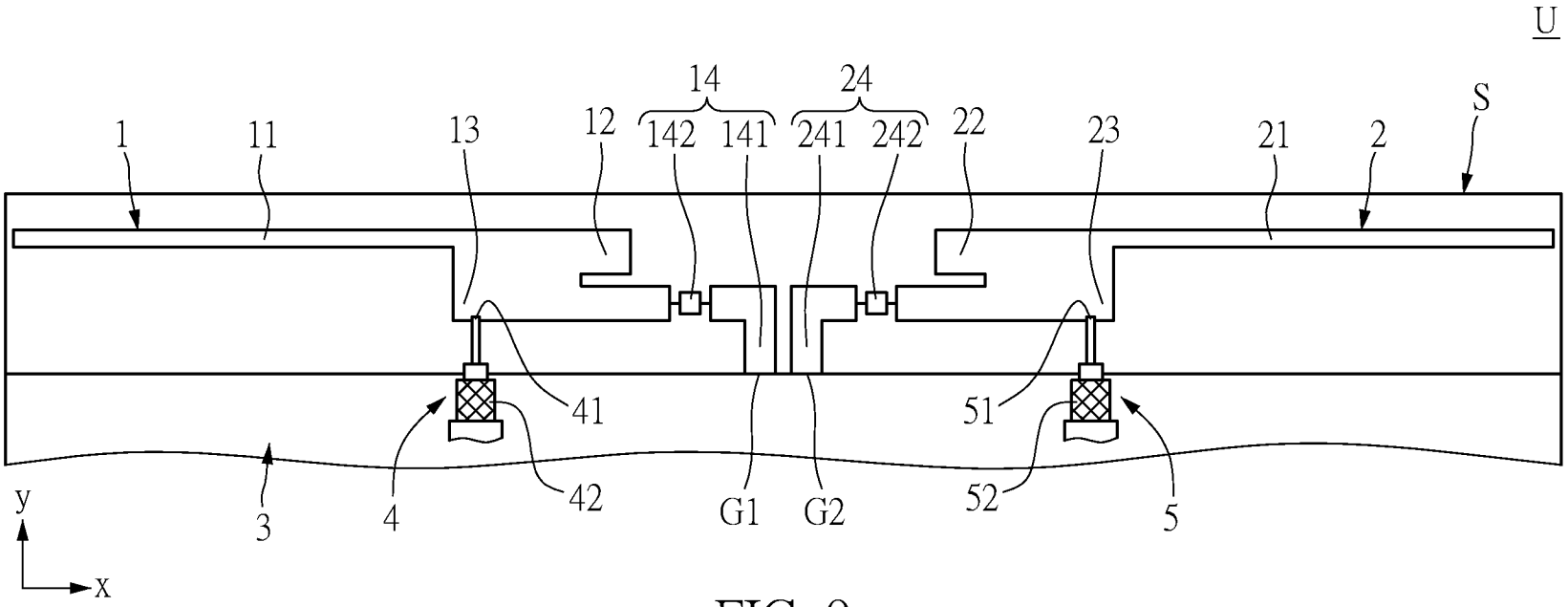
FIG. 9 is a top view of another configuration of the antenna structure according to the second embodiment of the present disclosure.

Next, reference is made to FIG. 9, which is a top view of another configuration of the antenna structure U according to the second embodiment of the present disclosure. It can be seen from the comparison between FIG. 9 and FIG. 8 that in the configuration shown in FIG. 9, the first grounding portion 14 includes the first grounding structure 141 and the first impedance element 142 coupled to the first grounding structure 141. In addition, the second grounding portion 24 includes the second grounding structure 241 and the second impedance element 242 coupled to the second grounding structure 241. It should be noted that the features of the first grounding structure 141, the first impedance element 142, the second grounding structure 241, and the second impedance element 242 are similar to those in the foregoing embodiment, and description thereof is omitted herein for brevity.

Figure 10:
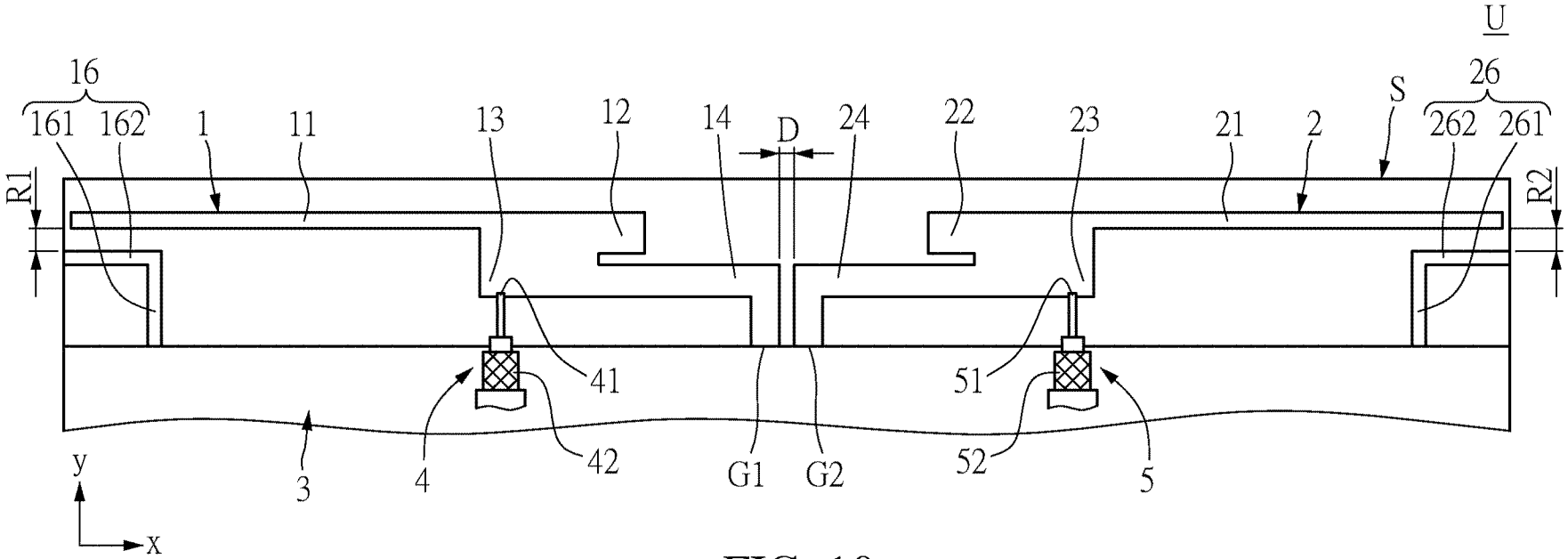
FIG. 10 is a top view of still another configuration of the antenna structure according to the second embodiment of the present disclosure.

Next, reference is made to FIG. 10, which is a top view of still another configuration of the antenna structure U according to the second embodiment of the present disclosure. As can be seen from the comparison between FIG. 10 and FIG. 8, in the configuration shown in FIG. 10, the first antenna 1 further includes the first parasitic member 16, and the first parasitic member 16 is disposed on the substrate S. The first parasitic member 16 has a first parasitic portion 161 coupled to the grounding member 3 and a second parasitic portion 162 bent from the first parasitic portion 161 and extending along a direction away from the first fed-in portion 13. The second parasitic portion 162 is adjacent to the first radiation portion 11. In addition, the second antenna 2 further includes a second parasitic member 26, and the second parasitic member 26 is disposed on the substrate S. The second parasitic member 26 is coupled to the grounding member 3, and the second parasitic member 26 has a third parasitic portion 261 coupled to the grounding member 3 and a fourth parasitic portion 262 bent from the third parasitic portion 261 and extending along a direction away from the second fed-in portion 23. The fourth parasitic portion 262 is adjacent to the third radiation portion 21. It should be noted that the features of the first parasitic member 16 and the second parasitic member 26 are similar to those of the foregoing embodiment, and description thereof is omitted herein for brevity.

Therefore, through the technical features of "the grounding member 3 is coupled to the first grounding portion 14 of the first antenna 1 and the second grounding portion 24 of the second antenna 2," the antenna structure U of the present disclosure reduces the mutual current interference between the first antenna 1 and the second antenna 2, and therefore improves the isolation between the first antenna 1 and the second antenna 2.

Further, through the technical features of "the first current path P1, the second current path P2 and the first ground current path L1 do not overlap with each other" and "the third current path P3, the fourth current path P4 and the second ground current path L2 do not overlap with each other," the antenna structure U of the present disclosure reduces the mutual current interference between the first antenna 1 and the second antenna 2, and therefore improves the isolation between the first antenna 1 and the second antenna 2.

Further, through the technical features of "a first interval W1 exists between the second radiation portion 12 and the first grounding portion 14, and a second interval W2 exists between the fourth radiation portion 22 and the second grounding portion 24," the antenna structure U of the present disclosure improves the isolation between the first antenna 1 and the second antenna 2.

Further, as the first grounding portion 14 of the first antenna 1 can be directly connected to the second grounding portion 24 of the second antenna 2 to form a common grounding portion, in the antenna structure U of the present disclosure, the first antenna 1 and the second antenna 2 have a common grounding structure.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An antenna structure, comprising:

a substrate;

a first antenna disposed on the substrate, including:

a first radiation portion;

a second radiation portion;

a first fed-in portion coupled between the first radiation portion and the second radiation portion; and a first grounding portion coupled to the first fed-in portion;

a second antenna disposed on the substrate, including:

a third radiation portion;

a fourth radiation portion;

a second fed-in portion coupled between the third radiation portion and the fourth radiation portion; and a second grounding portion coupled to the second fed-in portion;

a grounding member coupled to the first grounding portion and the second grounding portion;

a first feeding member for feeding in a first signal, including:

a first feed end coupled to the first fed-in portion; and a first ground end coupled to the grounding member; and a second feeding member for feeding in a second signal, including:

a second feed end coupled to the second fed-in portion; and a second ground end coupled to the grounding member, wherein the first feed end and the first radiation portion forms a first current path, the first feed end and the second radiation portion forms a second current path, the first feed end and the first grounding portion forms a first ground current path, and the first current path, the second current path and the first ground current path do not overlap with each other; and wherein the second feed end and the third radiation portion forms a third current path, the second feed end and the fourth radiation portion forms a fourth current path, the second feed end and the second grounding portion forms a second ground current path, and the third current path, the fourth current path and the second ground current path do not overlap with each other.

2. The antenna structure according to claim 1, wherein the first grounding portion is directly connected with the second grounding portion.

3. The antenna structure according to claim 1, wherein the first grounding portion and the second grounding portion are separated from each other.

4. The antenna structure according to claim 1, wherein the first grounding portion is coupled to the grounding member at a first grounding site, a length between the first feed end and the first grounding site is defined as a first electrical length, the first electrical length is substantially one-fourth of a wavelength of a center frequency of a lowest operating frequency band of the first antenna; and wherein the second grounding portion is coupled to the grounding member at a second grounding site, a length between the second feed end and the second grounding site is defined as a second electrical length, the second electrical length is substantially one-fourth of a wavelength of a center frequency of a lowest operating frequency band of the second antenna.

5. The antenna structure according to claim 1, wherein the first grounding portion includes a first grounding structure and a first impedance element coupled to the first grounding structure, the second grounding portion includes a second grounding structure and a second impedance element coupled to the second grounding structure, and each of the first impedance element and the second impedance element is a resistor, an inductor or a capacitor.

6. The antenna structure according to claim 1, wherein the first radiation portion generates a first operating frequency band, the second radiation portion generates a second operating frequency band, the third radiation portion generates a third operating frequency band, and the fourth radiation portion generates a fourth operating frequency band; and wherein each of the first operating frequency band and the third operating frequency band ranges between 2400 MHz and 2500 MHz, and each of the second operating frequency band and the fourth operating frequency band ranges between 5000 MHz and 6000 MHz.

7. The antenna structure according to claim 1, wherein the first antenna further includes a third grounding portion coupled to the first fed-in portion, the second antenna further includes a fourth grounding portion coupled to the second fed-in portion, and the first grounding portion and the second grounding portion are located between the third grounding portion and the fourth grounding portion.

8. The antenna structure according to claim 7, wherein the first antenna further includes a first parasitic member coupled to the grounding member, having:

a first parasitic portion coupled to the grounding member; and a second parasitic portion bent from the first parasitic portion and extending along a direction away from the first fed-in portion; and wherein the second antenna further includes a second parasitic member coupled to the grounding member, having:

a third parasitic portion coupled to the grounding member; and a fourth parasitic portion bent from the third parasitic portion and extending along a direction away from the second fed-in portion.

9. The antenna structure according to claim 1, wherein the first radiation portion and the fourth radiation portion extend along a first direction, the second radiation portion and the third radiation portion extend along a second direction, and the first direction is different from the second direction.

10. An antenna structure, comprising:

a substrate;

a first antenna disposed on the substrate, including:

a first radiation portion;

a second radiation portion;

a first fed-in portion coupled between the first radiation portion and the second radiation portion; and a first grounding portion coupled to the first fed-in portion;

a second antenna disposed on the substrate, including:

a third radiation portion;

a fourth radiation portion;

a second fed-in portion coupled between the third radiation portion and the fourth radiation portion; and a second grounding portion coupled to the second fed-in portion;

a grounding member coupled to the first grounding portion and the second grounding portion;

a first feeding member for feeding in a first signal, including:

a first feed end coupled to the first fed-in portion; and a first ground end coupled to the grounding member; and a second feeding member for feeding in a second signal, including:

a second feed end coupled to the second fed-in portion; and a second ground end coupled to the grounding member, wherein a first gap is provided between the second radiation portion and the first grounding portion, and a second gap is provided between the fourth radiation portion and the second grounding portion.

11. The antenna structure according to claim 10, wherein the first grounding portion is directly connected with the second grounding portion.

12. The antenna structure according to claim 10, wherein the first grounding portion and the second grounding portion are separated from each other.

13. The antenna structure according to claim 10, wherein the first grounding portion is coupled to the grounding member at a first grounding site, a length between the first feed end and the first grounding site is defined as a first electrical length, the first electrical length is substantially one-fourth of a wavelength of a center frequency of a lowest operating frequency band of the first antenna; and wherein the second grounding portion is coupled to the grounding member at a second grounding site, a length between the second feed end and the second grounding site is defined as a second electrical length, the second electrical length is substantially one-fourth of a wavelength of a center frequency of a lowest operating frequency band of the second antenna.

14. The antenna structure according to claim 10, wherein the first grounding portion includes a first grounding structure and a first impedance element coupled to the first grounding structure, the second grounding portion includes a second grounding structure and a second impedance element coupled to the second grounding structure, and each of the first impedance element and the second impedance element is a resistor, an inductor or a capacitor.

15. The antenna structure according to claim 10, wherein the first radiation portion generates a first operating frequency band, the second radiation portion generates a second operating frequency band, the third radiation portion generates a third operating frequency band, and the fourth radiation portion generates a fourth operating frequency band; and wherein each of the first operating frequency band and the third operating frequency band ranges between 2400 MHz and 2500 MHz, and each of the second operating frequency band and the fourth operating frequency band ranges between 5000 MHz and 6000 MHz.

16. The antenna structure according to claim 10, wherein the first antenna further includes a third grounding portion coupled to the first fed-in portion, the second antenna further includes a fourth grounding portion coupled to the second fed-in portion, and the first grounding portion and the second grounding portion are located between the third grounding portion and the fourth grounding portion.

17. The antenna structure according to claim 16, wherein the first antenna further includes a first parasitic member coupled to the grounding member, having:

a first parasitic portion coupled to the grounding member; and a second parasitic portion bent from the first parasitic portion and extending along a direction away from the first fed-in portion; and wherein the second antenna further includes a second parasitic member coupled to the grounding member, having:

a third parasitic portion coupled to the grounding member; and a fourth parasitic portion bent from the third parasitic portion and extending along a direction away from the second fed-in portion.

* * * * *